US008188444B2

(12) United States Patent
Zimmer

(10) Patent No.: US 8,188,444 B2
(45) Date of Patent: May 29, 2012

(54) ANALYTIC SPECTROMETERS WITH NON-RADIOACTIVE ELECTRON SOURCES

(75) Inventor: Klaus Zimmer, Parthenstein/OT Klinga (DE)

(73) Assignee: Bruker Daltonik GmbH, Bremen (DE)

( * ) Notice: Subject to any disclaimer, the term of this patent is extended or adjusted under 35 U.S.C. 154(b) by 339 days.

(21) Appl. No.: 12/349,957

(22) Filed: Jan. 7, 2009

(65) Prior Publication Data

US 2009/0200459 A1 Aug. 13, 2009

(30) Foreign Application Priority Data

Jan. 9, 2008 (DE) ..... 10 2008 003 676

(51) Int. Cl.
*H01J 49/10* (2006.01)

(52) U.S. Cl. ..... 250/423 F; 250/423 R; 250/424; 250/427; 250/281; 250/282; 250/288

(58) Field of Classification Search ..... 250/423 R, 250/424, 427, 423 F, 281, 282, 288
See application file for complete search history.

(56) References Cited

U.S. PATENT DOCUMENTS 5,153,519 A * 10/1992 Wentworth et al. ..... 324/464
5,969,349 A * 10/1999 Budovich et al. ..... 250/286
6,023,169 A 2/2000 Budovich et al.
7,385,210 B2 6/2008 Ulrich et al.
2006/0169892 A1* 8/2006 Baba et al. ..... 250/292
2006/0197537 A1 9/2006 Arnold et al.
2007/0075240 A1* 4/2007 Hieke ..... 250/282
2008/0122370 A1* 5/2008 Komatsu et al. ..... 315/169.1
2010/0066380 A1* 3/2010 Knapp et al. ..... 324/462

FOREIGN PATENT DOCUMENTS

WO WO 2004/048964 * 6/2004
WO WO 2004/048964 A1 6/2004

OTHER PUBLICATIONS

Weiser, et al., "Vacuum Ultraviolet Rare Gas Excimer Light Source", Rev. Sci. Instrum. vol. 68, No. 3, American Institute of Physics, Mar. 1997, pp. 1360-1364.

* cited by examiner

*Primary Examiner* — David A Vanore
*Assistant Examiner* — Nicole Ippolito
(74) *Attorney, Agent, or Firm* — Law Offices of Paul E. Kudirka

(57) ABSTRACT

In an analytical spectrometer in which accelerated electrons are used to ionize analytes, a non-radioactive electron source uses a gas discharge to generate the electrons. The gas discharge is located in a substantially hermetic source chamber and the free electrons in the plasma of the gas discharge are accelerated in an electric acceleration region towards a partition wall which separates the source chamber from a reaction chamber. The partition wall is permeable to the accelerated electrons but impermeable to gas in the source chamber so that the electrons penetrate the partition wall into the reaction chamber and generate primary ions that chemically ionize the analytes.

15 Claims, 2 Drawing Sheets

ANALYTIC SPECTROMETERS WITH NON-RADIOACTIVE ELECTRON SOURCES

BACKGROUND

The present invention relates to a spectrometer with a non-radioactive electron source for the chemical ionization of the substances under analysis. Such spectrometers include ion mobility spectrometers, electron capture detectors, and certain mass spectrometers. With this invention, possibly polluted gases can be analyzed and continuously monitored in a wide range of applications, for example in environmental analysis, in the control of chemical processes, and in civil and military applications to detect CWAs (chemical warfare agents) or explosives.

Ion mobility spectrometry is a method introduced in the 1970s for the highly sensitive detection of dangerous substances at low concentrations in air or other sample gases. An ion mobility spectrometer can be operated at atmospheric pressure and can be manufactured in a relatively compact form. Ion mobility spectrometers are therefore particularly suitable to be used as portable and mobile gas monitors and warning devices. Time-of-flight ion mobility spectrometers are the most widely used type. There are also "Aspiration Ion Mobility Spectrometers" from the Finnish company Environics Oy and "Asymmetric Field Ion Mobility Spectrometers" (FAIMS).

An ion mobility spectrometer generally consists of a reaction chamber, where ions of the substances under analysis (analyte ions) are generated, and a drift chamber, where the ions are separated according to their mobility in a drift gas. In FAIMS instruments they are separated according to the degree to which their mobility depends on the field strength. Radioactive electron emitting materials such as tritium, nickel-63, or americium-241 are usually used to ionize the substances. The disadvantage of radioactive ionization sources is that their use can be hazardous to the environment and dangerous to the health of the service personnel. Attempts have therefore been made to use non-radioactive electron sources such as photo-emitters or a corona discharge inside the reaction chamber. In both cases, however, experience has shown that the ionization processes which occur are not the same as with a radioactive ionization source, and so different species of analyte ions are produced or, in some cases, no analyte ions at all.

The patent specification by Budovich et al. (DE 196 27 621 C1) elucidates an ion mobility spectrometer that uses a non-radioactive electron source to produce electrons in an evacuated source chamber. An electric field accelerates the electrons, to 20 kiloelectronvolts for example, and they pass, from the source chamber through a window which is impermeable to gas and into a reaction chamber at atmospheric pressure, whereby they are partially decelerated. The electrons ionize the gas in the reaction chamber, as happens in the case of a radioactive electron source. The primary ions thus generated are the starting point for a chain of ionization reactions which ends with the substances under analysis also being ionized. The partition wall prevents the substances under analysis or the analyte ions from coming into contact with the electron source.

In the embodiments given in Budovich et al., the non-radioactive electron source is a photo-emitter or a thermal emitter, both of which require an operating pressure of less than 0.01 pascal in order to function. But ion mobility spectrometers do not generally have an integrated vacuum system which can be used to evacuate such a source chamber. In order for the non-radioactive electron source to have a commercially relevant operational lifetime, the gas permeability (leak rate) of the window should be low enough that the pressure increase in the source chamber is less than $10^{-10}$ pascal liters per second.

A window used by Budovich et al. consists of a mica disk approx. three to five micrometers thick, which withstands the pressure difference. The leak rate of the mica disk is sufficiently low. The ion currents in the ion mobility spectrometer, however, prove to be significantly smaller than those produced when a commercial radioactive electron source (nickel-63) with an activity of 100 megabecquerel, the currently permitted limit, is used. This is because the permeability of the mica disk to electrons with an energy of 20 kiloelectronvolts is low.

Electron sources are known from other fields of application which have silicon nitride windows that are permeable to electrons and impermeable to gas; these windows are less than 300 nanometers thick (Ulrich et al.: "Excitation of dense gases with low-energy electron beams", in: Physikalische Blätter, 56 (2000), No. 6, Pages 49 to 52). If such windows are used in an ion mobility spectrometer at electron energies of about 20 kiloelectronvolts, more than a third of the electrons from the source chamber can reach the reaction chamber. At a diameter of about one millimeter, the thin windows withstand a pressure of one atmosphere. Apart from thickness and material, it is particularly the temperature of the window that is decisive for its gas permeability, which increases disproportionately to the window's temperature. The window heats up as the electrons pass through it because part of the electron energy always remains in the window. Therefore two opposing effects related to the thickness of the window must be taken into account in order to design a window with minimum gas permeability: on the one hand, thinner windows heat up less because they have better electron permeability; on the other hand, thicker windows are less permeable to gas than thinner windows.

Another patent specification of Budovich et al. (DE 196 27 620 C1) presents an electron capture detector with a non-radioactive electron source located in a source chamber and separated from the reaction chamber by a partition wall which is permeable to electrons but impermeable to gas. It is also possible to use such an ionization source in mass spectrometers.

SUMMARY

The invention comprises a non-radioactive electron source that uses a gas discharge. The free electrons in the plasma of the gas discharge are accelerated in an electric acceleration region onto a partition wall which separates the source chamber and the reaction chamber of the ion mobility spectrometer, and which is permeable to the accelerated electrons but impermeable to gas.

The partition wall can be a constituent part of the gas discharge arrangement. In order to decouple the operating conditions of the ion mobility spectrometer and the gas discharge, only a proportion of the electrons from the plasma of the gas discharge are extracted and accelerated onto the partition wall. A pressure difference of about one atmosphere ($6\times10^4$ to $1.2\times10^5$ pascal) can be maintained between the source chamber and the reaction chamber by means of the partition wall. A proportion of the electrons pass through the partition wall into the reaction chamber, where they produce primary ions for the chemical ionization of the substances under analysis. The ionization of the substances can occur inside the reaction chamber itself or in another chamber, into which the primary ions are transferred and the substances are introduced.

In the source chamber, the electrons are preferably accelerated to energies of between 2 and 100 kiloelectronvolts, in particular to about 15 kiloelectronvolts.

In the plasma of the gas discharge, the electrons undergo collisions which counteract their acceleration. The electron energy at the partition wall therefore depends on the accelerating voltage and also on the particle density, i.e. on the pressure in the source chamber.

The pressure in the source chamber is preferably maintained to a value in the range between 0.1 and 1000 pascal, in particular to about 10 pascal. The pressure specified for the source chamber must always be understood as the gas pressure before the plasma is ignited. Whereas photo-emitters, thermal emitters and field emitters can only be operated for long periods if they are in a high vacuum of below 0.001 pascal, the pressure requirements of a gas discharge are reduced to a rough vacuum between about 0.1 and 1000 pascal. The electrons can be accelerated to the required electron energy even at pressures above 0.1 pascal. Therefore, in ion mobility spectrometers according to the invention, it is possible to use windows whose leak rates have, until now, restricted or completely precluded their use for commercially relevant operating periods. Particularly worth mentioning here are the above-described windows with thicknesses of less than 300 nanometers. Using a gas discharge as a non-radioactive electron source it is possible to significantly increase the operating time of an ion mobility spectrometer with such windows.

There are numerous types of gas discharges, which are distinguished, for example, by electrode geometry, type of gas, pressure, voltages applied to the electrodes (DC or AC), use of a magnetic field, or duration of the gas discharge (pulsed or continuous). In an ion mobility spectrometer according to the invention it is possible to use a glow discharge, an arc discharge, a corona discharge, a hollow cathode discharge or a dielectric barrier discharge as a non-radioactive electron source, for example. The electrodes of the gas discharge can be located inside or outside the source chamber. The electrodes of the electric acceleration region can be located together with those of the gas discharge or separately, either inside or outside the source chamber. In addition to these electrodes, there can also be one or more additional electrodes which are used to ignite the plasma of the gas discharge.

The use of a gas discharge as a non-radioactive electron source has the major advantage that the electron current in the reaction chamber can be many orders of magnitude higher than that of a nickel-63 electron source with an activity of 100 megabecquerel, the currently legal limit. This means that ion mobility spectrometers according to the invention have a better signal-to-noise ratio and significantly lower detection limits.

In order to compare the measured signals of an ion mobility spectrometer according to the invention over the whole operating period, the ionizing electron current in the reaction chamber must be either held constant or measured. The electron current at the partition wall can be used to regulate the electron current into the reaction chamber or to calculate a correction of the measured signals.

The method described here for the chemical ionization of substances can easily be transferred to other analytical instruments in which substances are ionized and the ions generated are detected, as is the case with electron capture detectors or mass spectrometers. The method according to the invention is particularly advantageous for analytical instruments which have no vacuum system because, in such cases, the leak rate of the partition wall determines the pressure in the source chamber and thus strongly influences the operating time of the electron source.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
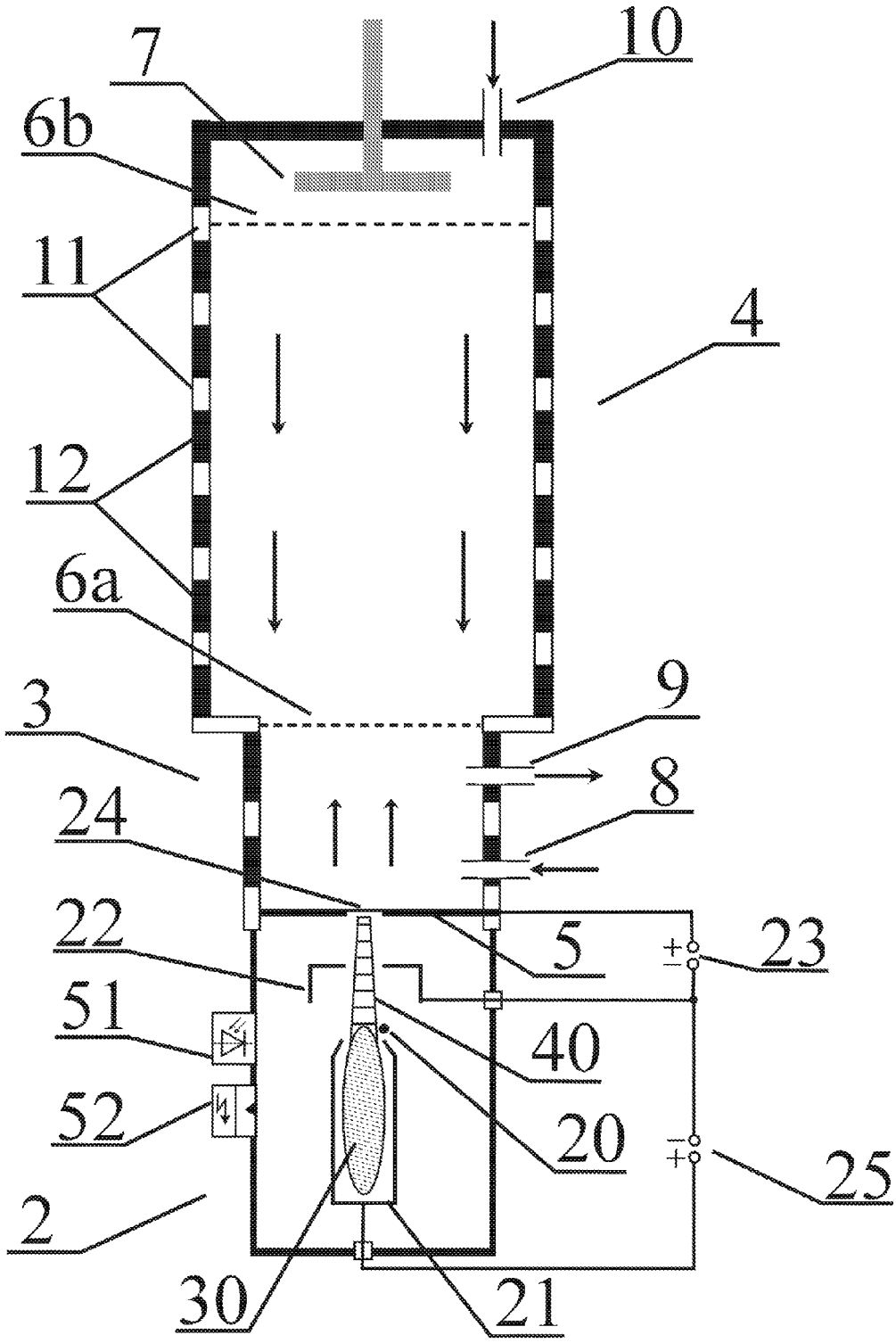
FIG. 1 shows a measuring cell (1) of a time-of-flight ion mobility spectrometer according to one embodiment of the invention which consists of a source chamber (2), a reaction chamber (3) and a drift chamber (4). A hollow cathode gas discharge with electrodes (21, 22) is located in the source chamber (2).

FIG. 1 is a schematic representation of the measuring cell (1). The reaction chamber (3) and the drift chamber (4) are both at atmospheric pressure. The source chamber (2) and the reaction chamber (3) are separated by a partition wall (5) containing a window (24) which is permeable to electrons but impermeable to gas.

A hollow cathode gas discharge consisting of a hollow cathode (21) and an anode (22) is located in the source chamber (2) as a non-radioactive electron source. The hollow cathode (21) and the anode (22) are connected to a high-voltage source (25). The anode (22) and the partition wall (5) with the window (24) are connected to the high-voltage source (23). The window (24) here is a 200 nanometers thick silicon carbide foil, which is connected to the partition wall (5) so as to be electrically conducting. The pressure in the source chamber (2) is around 10 pascal. The leak rate of the window (24) is so small that the pressure in the source chamber (2) increases only slightly even when the gas discharge is in operation, and therefore no vacuum pump is required. The gas discharge is preferably operated with hydrogen or a noble gas; particularly preferred, however, is argon. An ignition electrode (20) is also located in the source chamber (2). Furthermore, a light sensor (51) and a pressure sensor (52) are located in the source chamber (2).

The reaction chamber (3) and the drift chamber (4) are separated by a gating grid (6*a*), which is connected to a pulsed voltage source (not shown). The housings of the chambers (3) and (4) each consist of metal rings (11), which are separated by rings (12) of insulating material, for example, ceramic. The metal rings (11) are connected via a voltage divider to a voltage source in such a way that an electric drift field in the direction of a collecting electrode (7) is generated in both chambers (3, 4). Immediately in front of the collecting electrode (7) is a screen grid (6*b*), which electrostatically decouples the collecting electrode (7) from the drift chamber (4). The voltage divider, the voltage source and electric measurement circuits are not shown for reasons of clarity.

Figure 2:
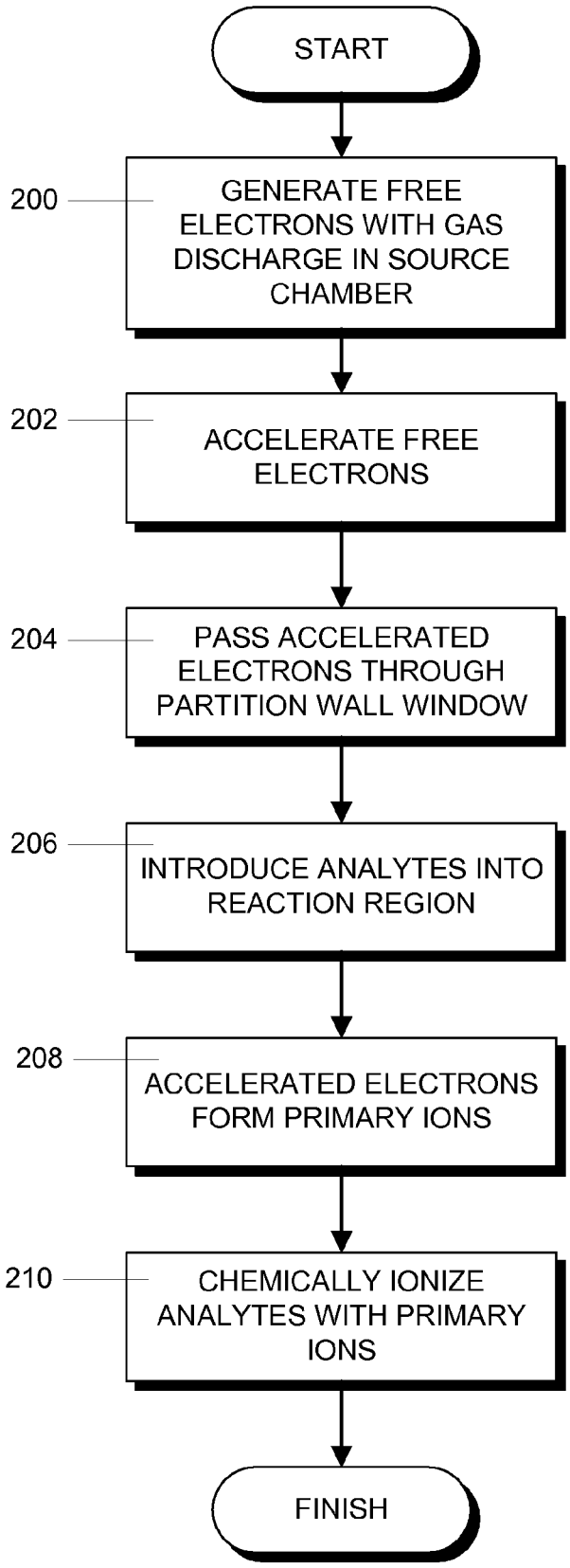
FIG. 2 is a flowchart showing the steps in an illustrative method for operating a spectrometer with a non-radioactive electron source according to the invention.

The measuring cell (1) of the ion mobility spectrometer operates as follows as illustrated in FIG. 2: In the source chamber (2), a plasma is ignited by a high-voltage pulse between the ignition electrode (20) and the hollow cathode (21), and is maintained by the high-voltage (25) between the hollow cathode (21) and the anode (22). The gas discharge plasma generates free electrons as set forth in step 200. The free electrons are then accelerated as set forth in step 202. The accelerating voltage of the high-voltage source (23) is preferably around 20 kilovolts and is sufficient for the accelerated electrons to pass through the window (24) and enter the reaction region (3) as set forth in step 204. The high-voltage source (23) can also take the form of a pulsed voltage source so that, in this case, a pulsed electron current impinges on the window (24). The accelerated electrons (40) are focused onto the window (24) by means of suitable positioning, dimensions and design of the anode (22).

In step 206, the substances under analysis are introduced into the reaction chamber (3) with a carrier gas via port (8). In the reaction chamber (3), the electrons interact with the carrier gas to produce primary ions as indicated in step 208, and with the substances under analysis. The range of the electrons in air at normal pressure is a few millimeters. In this spatially restricted region of the reaction chamber (3), it is mainly primary ions of the carrier gas which are produced, and these form the starting point for a chain of ionization reactions. The substances under analysis are ionized in the reaction chamber (3) by reactions with the primary ions or with secondary ions created in subsequent reactions as indicated in step 210.

The voltages applied to the metal rings (11) generate an electric field, in which the ions produced in the reaction chamber (3) (positive or negative ions, depending upon the polarity of the DC voltage source) move toward the gating grid (6*a*). Periodic short (between 0.1 and 5 milliseconds) voltage pulses are applied to the gating grid (6*a*) and open it so that ion packages enter the drift chamber (4). The ions move in the electric drift field of the drift chamber (4) toward the screen electrode (6*b*) and the collecting electrode (7). In the drift chamber (4), the ions are temporally separated due to their different ion mobilities. When the ions impinge on the collecting electrode (7) they produce an electric current, which is amplified and measured by an electric circuit. The measured curve of the ion current against the drift time is called an ion mobility spectrum. The drift times are characteristic of the respective substances.

Drift gas which does not contain any substances is introduced into the drift chamber (4) via the port (10) and flows from the collecting electrode (7) to the gating grid (6*a*). The direction of flow is in the opposite direction to the drift of the ions to the collecting electrode (7), thus preventing carrier gas containing substances from flowing out of the reaction region (3) into the drift chamber (4) and the substances being ionized only when they arrive there. The gas introduced at ports (8) and (10) is pumped off from the reaction chamber (3) with any substances not ionized via port (9).

The magnitude of the measuring signals from the measuring cell (1) for a given concentration of substance is determined by the strength of the ionizing electron current in the reaction chamber (3), among other factors. This dependency can be used, on the one hand, to normalize the measurement signals and, on the other, to improve the signal-to-noise ratio and/or the detection limit. In order to control the electron current, it must be possible to adjust the electron current and there must be a control variable for it. The electron current can be adjusted via the voltage source (23). It can also be adjusted by defocusing the electron beam (40) if, by so doing, a part of the electron beam (40) impinges on the part of the partition wall (5) that is impermeable to electrons. The control variable can be, for example, the electron current at the partition wall (5), the ion current at the gating grid (6*a*) in its closed state, the pressure in the source chamber (2), the electromagnetic emission of the plasma (30), or a combination of these control variables.

The advantage of an ion mobility spectrometer according to the invention lies in the fact that the requirement regarding the leak rate of the window permeable to electrons decreases dramatically, but an electron current can nevertheless be produced which is several orders of magnitude higher than the electron currents produced by legally permissible radioactive electron sources. This increases the operating time of the non-radioactive electron source and at the same time lowers the detection limits for the analytes. With knowledge of the invention, those skilled in the art can design a large number of further embodiments according to the invention. The ion mobility spectrometers according to the invention are particularly not restricted to the time-of-flight type. The method according to the invention can also be advantageously used in other analytical instruments which have no vacuum pumps, such as electron capture detectors, and also in mass spectrometers.

What is claimed is:

1. An analytical spectrometer comprising:

a substantially hermetic source chamber;

a non-radioactive electron source that is located in the source chamber filled with a gas having a pressure between 10 and 1000 pascal and uses a gas discharge to generate electrons;

a reaction chamber which is separated from the source chamber by a partition wall that is permeable to electrons and impermeable to gas; and a voltage source that is located in the source chamber and applies an electric acceleration voltage with a value between 2 and 100 kilovolts to the electrons in an electric acceleration region.

2. The spectrometer of claim 1, wherein the electric acceleration region is formed by electrodes used to generate the gas discharge.

3. The spectrometer of claim 1, wherein the gas discharge comprises one of the group consisting of a glow discharge, a corona discharge, a hollow cathode discharge, an arc discharge and a dielectric barrier discharge.

4. The spectrometer of claim 1, wherein the gas in the source chamber is one of a noble gas and hydrogen.

5. The spectrometer of claim 1, wherein the reaction chamber is filled with a gas having a pressure between $6\times10^4$ and $1.2\times10^5$ pascal.

6. The spectrometer of claim 1 wherein the spectrometer is an ion mobility spectrometer.

7. The spectrometer of claim 1 wherein the spectrometer is an electron capture detector.

8. The spectrometer of claim 1 wherein the spectrometer is a mass spectrometer.

9. A method for the chemical ionization of analytes in a spectrometer having a source chamber, a reaction chamber and a partition wall that separates the source chamber and the reaction chamber and is permeable to electrons but impermeable to gas, the method comprising:

(a) generating free electrons with a gas discharge in a source chamber filled with a gas having a pressure between 10 and 1000 pascals;

(b) accelerating the free electrons in an electric field to energies between 2 and 200 kiloelectronvolts and towards the partition wall;

(c) passing the accelerated electrons through the partition wall into the reaction region; and (d) using the accelerated electrons in the reaction region to form primary ions that chemically ionize the analytes.

10. The method of claim 9, wherein step (d) comprises introducing the analytes into the reaction chamber.

11. The method of claim 9, further comprising:

(e) detecting and measuring signals produced by ionized analytes in the reaction chamber;

(f) measuring a value of electron current at the partition wall; and (g) correcting the signals detected and measured in step (e) using the value of the electron current measured in step (f).

12. The method of claim 9, further comprising:

(e) measuring a value of electron current at the partition wall; and (f) adjusting the value of the electron current measured in step (e) to a predetermined constant.

13. The method of claim 9, further comprising:

(e) measuring a value of ion current of primary ions in the reaction chamber;

(f) measuring a value of electron current at the partition wall; and (g) adjusting the value of the electron current measured in step (f) based on the value of the ion current measured in step (e).

14. The method of claim 9, further comprising:

(e) measuring a pressure of gas in the source chamber;

(f) measuring a value of electron current at the partition wall; and (g) adjusting the value of the electron current measured in step (f) based on the gas pressure measured in step (e).

15. The method of claim 9, further comprising:

(e) measuring an electromagnetic emission of the gas discharge;

(f) measuring a value of electron current at the partition wall; and (g) adjusting the value of the electron current measured in step (f) based on the electromagnetic emission measured in step (e).

* * * * *